US006354317B1

(12) United States Patent
Lah

(10) Patent No.: US 6,354,317 B1
(45) Date of Patent: Mar. 12, 2002

(54) TENT STABILIZER

(76) Inventor: Jek Kun Lah, 542-3 Gajwa-Dong, Su-Ku, Inchon 404-250 (KR)

( * ) Notice: Subject to any disclaimer, the term of this patent is extended or adjusted under 35 U.S.C. 154(b) by 0 days.

(21) Appl. No.: 09/638,383

(22) Filed: Aug. 12, 2000

(51) Int. Cl.[7] ..... E04H 15/64

(52) U.S. Cl. ..... 135/119; 135/118; 135/120.1; 135/120.2; 135/120.4; 135/120.3

(58) Field of Search ..... 135/118, 119, 135/120.1, 120.2, 120.3, 120.4

(56) References Cited

U.S. PATENT DOCUMENTS 4,195,651 A * 4/1980 Watts ..... 135/120.3
4,352,362 A * 10/1982 Nichols ..... 135/120.3
4,657,299 A * 4/1987 Mahan ..... 135/88.01
4,782,846 A * 11/1988 Ting ..... 135/120.1
5,333,634 A * 8/1994 Taylor ..... 135/118
5,404,896 A * 4/1995 Howe ..... 135/119
5,615,699 A * 4/1997 Lee ..... 135/118
5,628,336 A * 5/1997 Lee ..... 135/114
5,771,912 A * 6/1998 Swetish ..... 135/119
5,901,726 A * 5/1999 Le Gal ..... 135/120.3
5,954,077 A * 9/1999 Wain ..... 135/119
5,988,194 A * 11/1999 Collins ..... 135/118
6,226,813 B1 * 5/2001 Wilburn ..... 135/118

* cited by examiner

*Primary Examiner*—Beth A. Stephan
(74) *Attorney, Agent, or Firm*—Dergosits & Noah LLP

(57) ABSTRACT

A device to stabilize a tent of the type having a fabric cover and a plurality of poles under tension. The device is characterized as having two rods connected to one another at a connector. The connector is provided with a channel approximating the size of the circular cross-section of the poles. The device is further provided with means to maintain the connector at a fixed position on the tent pole as well as means to maintain the spacing between the rods regardless of the climatic conditions being encountered.

13 Claims, 6 Drawing Sheets

TENT STABILIZER

TECHNICAL FIELD OF INVENTION

The present invention involves a device which can be removably applied to one or more tent poles in order to stabilize a tent against collapse from external forces such as high velocity winds.

BACKGROUND OF THE INVENTION

Tents are provided in a myriad of shapes and sizes, most of which are designed for backpack and hiking applications and are designed to be lightweight and collapsible. Such tents seem to share certain basic design criteria shown generally in reference to FIG. 1.

FIG. 1 depicts a somewhat schematic skeletal view of a typical lightweight portable tent of the type to which the present invention is intended to improve upon. Tent 10 is provided with a fabric cover 12 and one or more doors or windows 12 to provide entrance and egress from the tent's interior. Tents of this type are further provided with a plurality of poles 13 which are generally collapsible and, when installed to support the tent volume, are under tension. Each tent pole 1 3 has a length and distal end 30 which is intended to be releasably captured by eyelet 25 (FIGS. 2 and 3) for supporting tent 10 on support surface 15.

Although tents such as that shown in FIG. 1 are lightweight, reasonably sturdy and readily collapsible, they do suffer from a certain degree of instability. Specifically, if high velocity winds impact the fabric cover 12 of tent 10, poles 13 can torque out of alignment. If wind velocities are high enough and at the appropriate angle, a catastrophic failure can occur where the entire tent collapses upon itself. Obviously, the consequences of a tent collapse when weather conditions are inclement could, in extreme cases, be life-threatening.

It is thus an object of the present invention to provide an inexpensive, easy to apply and completely removable stabilizing device for making tents of the type shown in FIG. 1 more resistant to collapse.

This and further objects will be more readily apparent when considering the following disclosure and appended claims.

SUMMARY OF THE INVENTION

The present invention involves a device to stabilize a tent. Tents which can employ such a device generally comprise fabric cover and a plurality of poles. The poles each have a length and a substantially circular cross-section and each pole is stressed under tension for engaging a portion of the fabric cover. Each of the poles further is provided with distal ends for engaging a support surface such as the ground upon which the tent resides. The device comprises two rods connected to one another at a connector. The connector is characterized as being able to be attached to a tent pole at a predetermined location. This location is maintained by various means while the distance between the two rods is also fixed. Such a device, when properly installed, greatly enhances the stability of the tent to which it is appended.

DETAILED DESCRIPTION OF THE INVENTION

Figure 1:
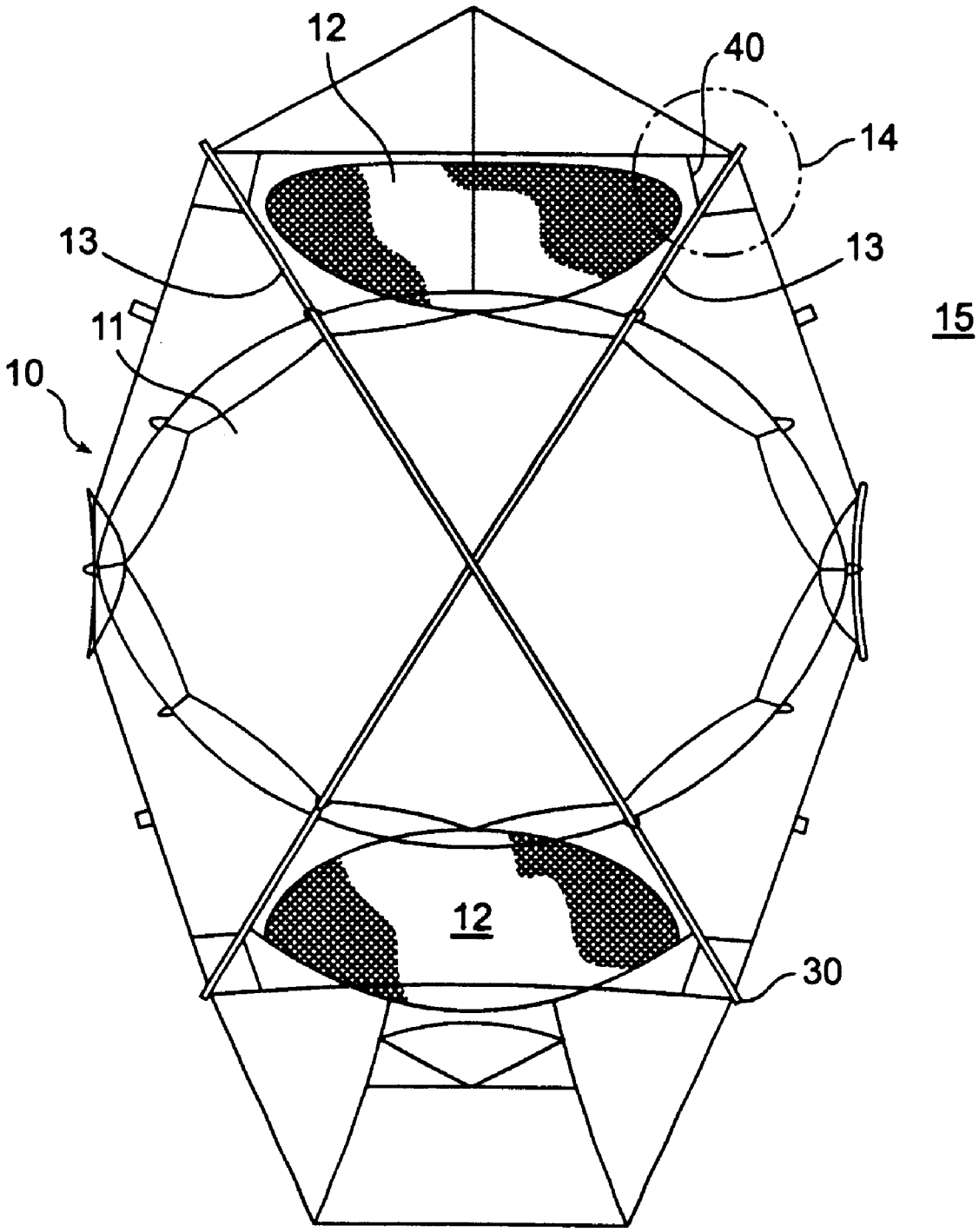
FIG. 1 is a top schematic view of a typical tent bearing the device of the present invention.

Tent 10 of FIG. 1 has been previously described. Shown as the distal ends 30 of tent poles 13 is the device of the present invention shown within circular portion 14. The device of the present invention is depicted in detail in FIG. 2.

Figure 2:
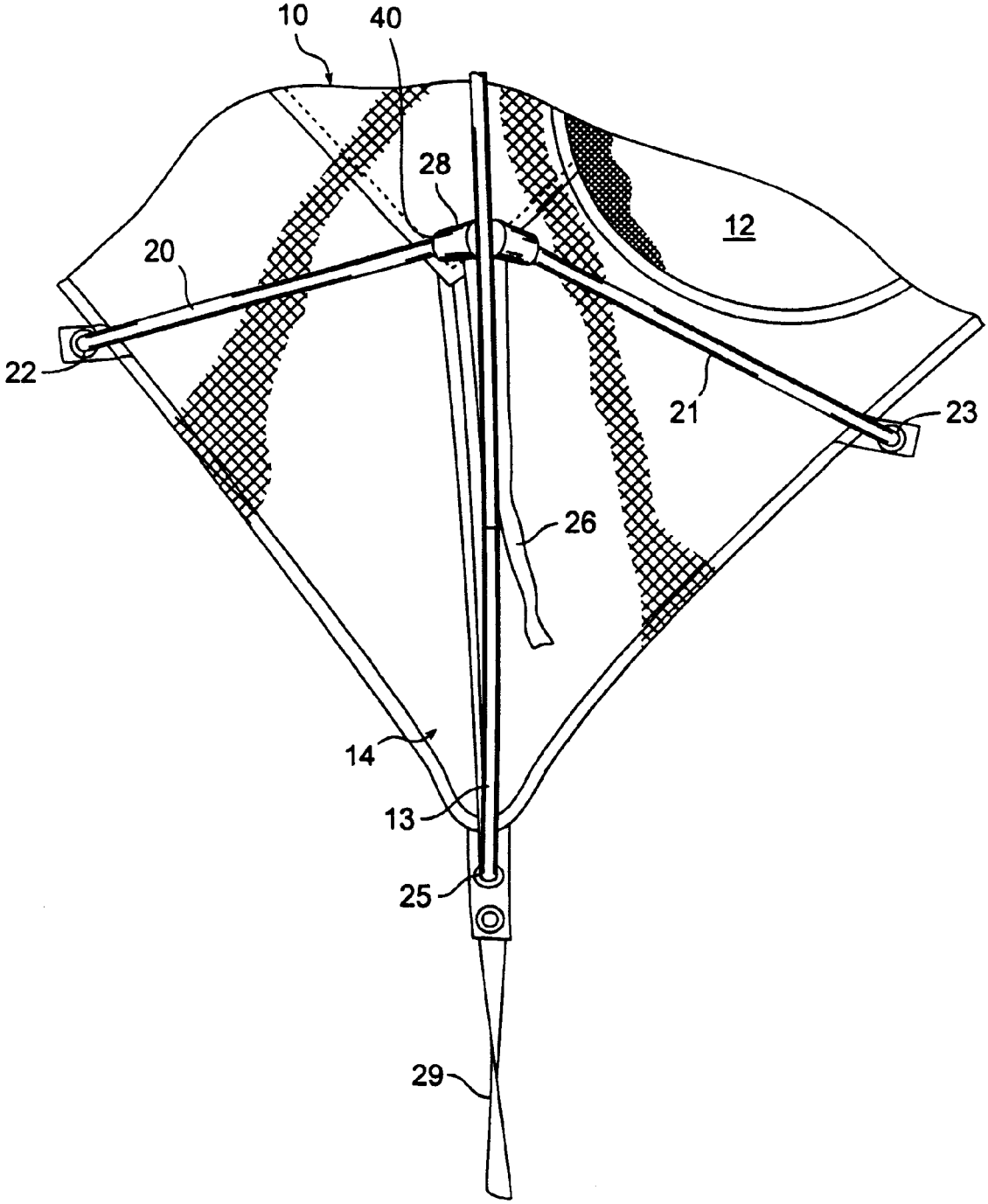
FIG. 2 is a perspective view of that portion of the tent of FIG. 1 contained within circle 14 in order to show the present device in more detail.

FIG. 2 depicts a corner of tent 10 whereby pole 13 is shown being releasably captured by eyelet 25 contained within fabric loop 29. As noted, severe external forces such as strong wind velocities can cause pole 13 to torque out of its position as shown in FIG. 2 causing, under extreme conditions, total tent collapse. In order to reduce this contingency, device 40 is provided.

At the outset, it must be noted that device 40 is completely removable from pole 13 as will be later discussed in detail. As such, the device of the present invention can be purchased as an after-market add-on to any existing tent in order to improve stability.

Device 40 comprises two rods 20 and 21 connected to one another at connector 28. Rods 20 and 21 can be composed of any suitable materials such as aluminum tubing while connector 28 can be composed of a high impact plastic or metal.

It is critical in practicing the present invention that the position of connector 28 along rod 13 be maintained constant in order to optimize the stabilizing function of the device of the present invention. It is a further design goal in maximizing stability to maintain the spacing of rods 20 and 21 even as high winds seek to collapse tent 10.

There are a number of ways to maintain the position of connector 28 on pole 13. One such embodiment is shown in FIG. 2 as strap 26. Although strap 26 is shown to loosely hang from connector 28 in FIG. 2, in operation, once device 40 is properly applied to pole 13, strap 26, passing between connector 28 and the distal end of pole 13 is under tension. This is shown in FIG. 3 which depicts a step-by-step simple method of attaching strap 26 to tent segment 27. Strap 26 is provided with loop 39 which enables connector 28 to pass through loop 29 after strap 26 has been passed through loop 29 of tent fabric section 27. Strap 26 is then pulled through loop 29 as shown providing a strap under tension as depicted in the final step of FIG. 3. Quite clearly, connector 28 is applied to pole 13 in such a position as to ensure that strap 26 is, in fact, under tension. This dictates the position of connector 28 along pole 13 under proper installation.

Figure 4:
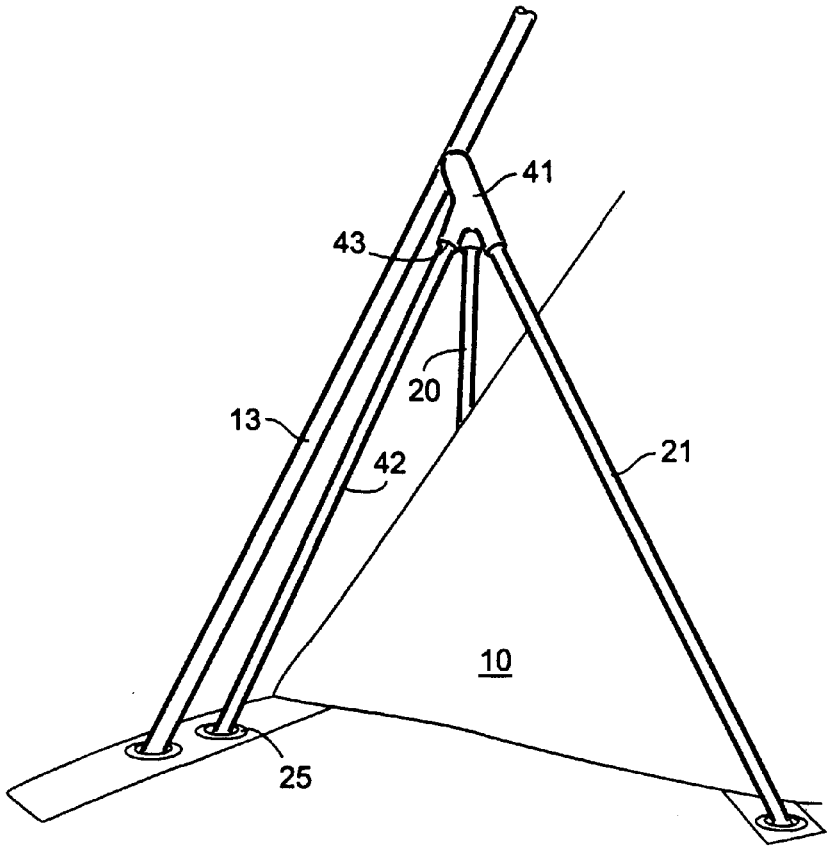
FIGS. 4 and 5 are perspective views of alternative embodiments of the present invention.

As noted previously, there are further embodiments which can be employed to maintain the position of connector 28 on pole 13. Turning to FIG. 4, connector 41 which supports rods 20 and 21 is maintained in position along pole 13 through the use of rod 42. Rod 42 can be employed in place of strap 26 (FIG. 2) by employing connector 41 having a receiving channel 43 molded therein. The opposite end of rod 42 is then captured by eyelet 25 as shown.

Figure 5:
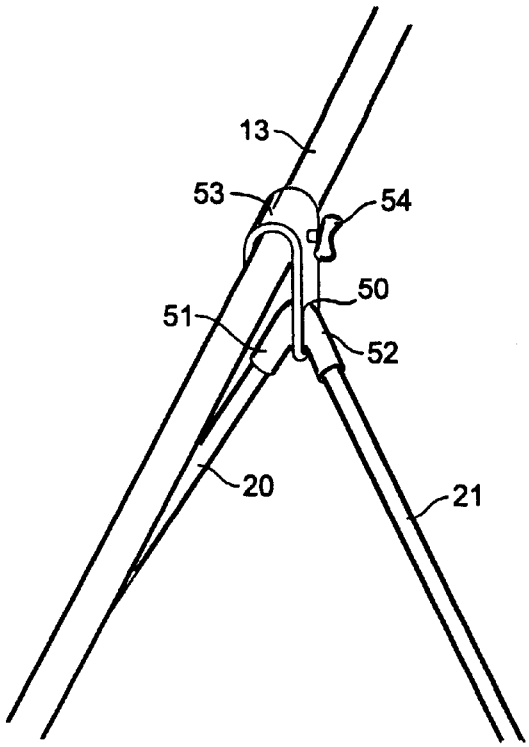

Alternatively, as noted by reference to FIG. 5, the strap of FIG. 2 and the rod of FIG. 4 can be completely eliminated by providing connector 50 having receiving slots 51 and 52 for accepting stabilizing rods 20 and 21. Emanating from connector 50 is hook 53 which is sized to capture tent pole 13. Once captured, a screw or cam (not shown) can be brought to bear upon pole 13 by turning element 54.

Figure 6:
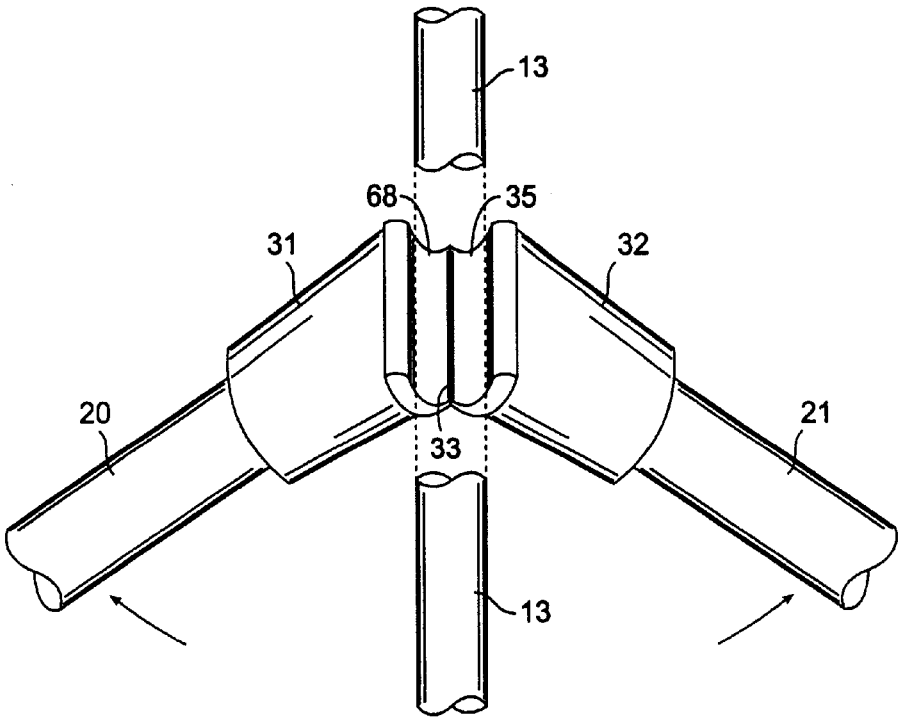
FIG. 6 is a perspective view showing detail of an alternative embodiment of the connector of the present invention.

Although three alternative means of maintaining the present tent stabilizer at a fixed location upon a tent pole are depicted, in practicing the present invention, virtually any expedient can be employed which accomplishes this design goal. For example, reference is made to FIG. 6 whereby connector 68 is shown having body sections 31 and 32 which can move with respect to one another along hinge 33 to widen or narrow channel 35. In use, rods 20 and 21, when drawn together, act to widen channel 35 so that connector 68 can slip over rod 13. Rods 20 and 21 can then be drawn apart to clamp connector 68 upon rod 13.

Figure 2A:
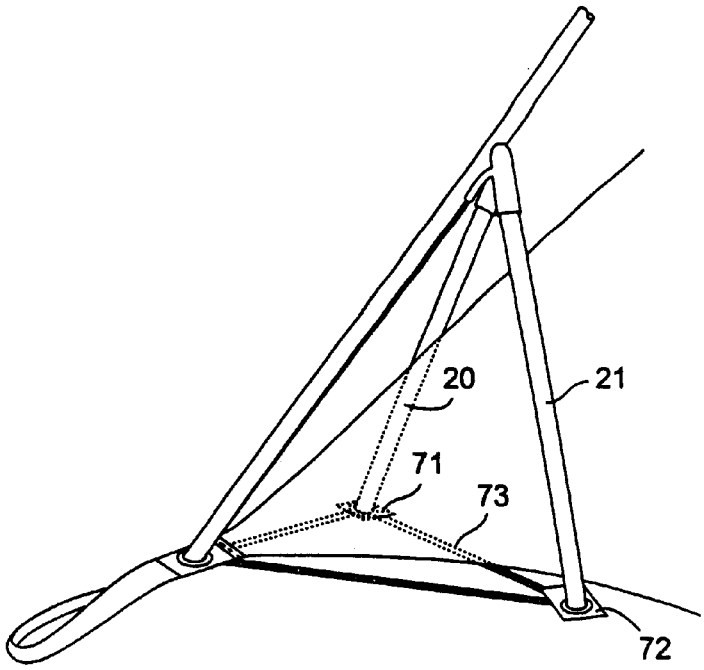
FIGS. 2A–C depict, in perspective, details of alternative embodiments of means to maintain rod spacing once the device is installed on a tent pole.
Figure 2B:
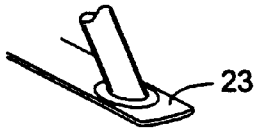
Figure 2C:
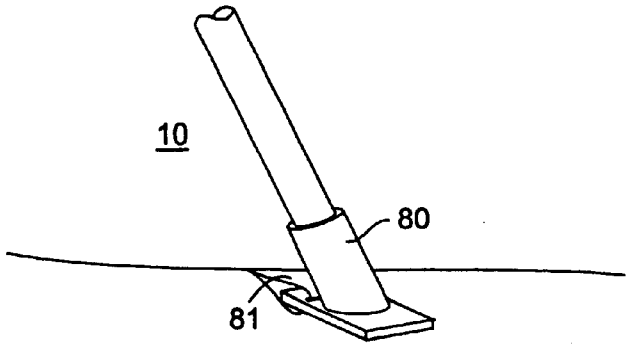
Figure 3A:
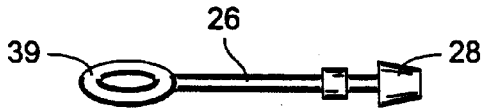
FIGS. 3A–E are a series of steps shown schematically illustrating a convenient way to connect the strap embodiment of the present invention to a portion of tent fabric.
Figure 3B:
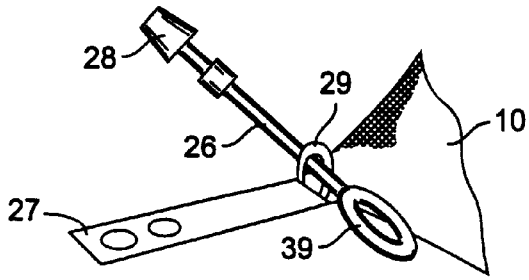
Figure 3C:
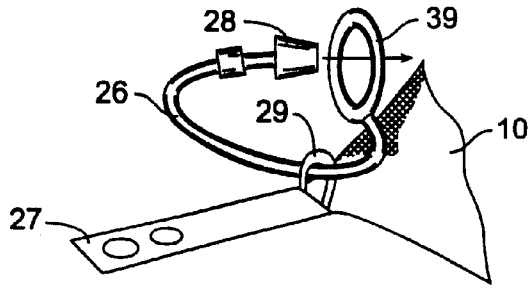
Figure 3D:
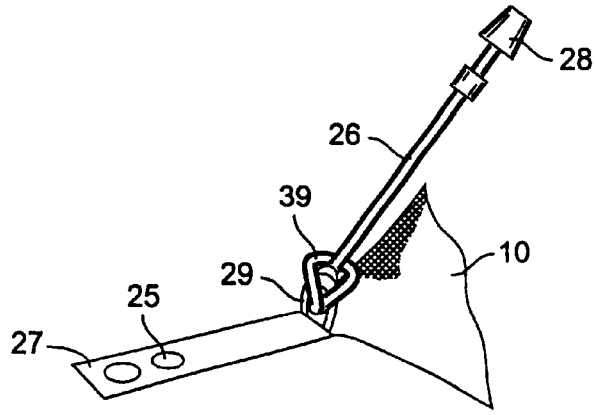
Figure 3E:
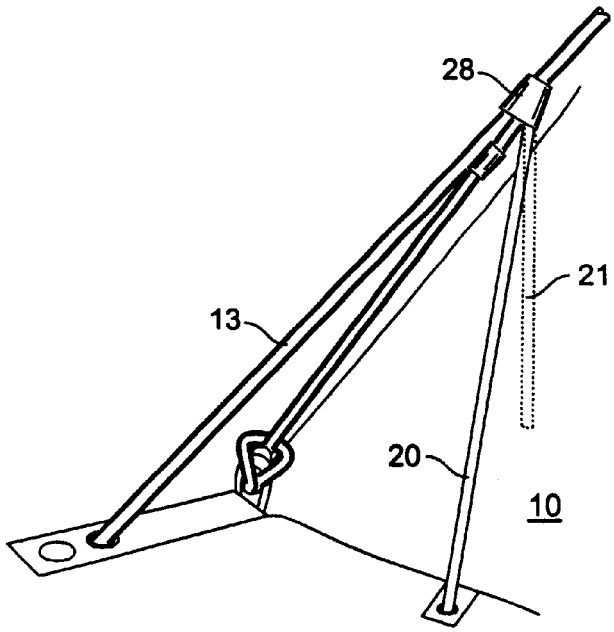

It is further noted that in use, the stabilizing device of the present invention acts most efficiently when the spacing between rods 20 and 21 are maintained constant. There are several ways in which this can be accomplished. For example, reference is made to FIG. 2 whereby grommets 22 and 23 appended to tent 10 are positioned to receive the distal ends of rods 20 and 21. Alternatively, reference is made to FIG. 2A whereby grommets 71 and 72 which are again positioned to receive the distal ends of rods 20 and 21 are not appended to tent 10 but instead are connected to one another through the use of cord or strap 73. By employing this embodiment, any existing tent can be fitted with the stabilizing device of the present invention as an after-market product by not concerning oneself with the necessity for grommets sewn onto the tent fabric. Alternatively, reference is made to FIG. 2C whereby grommets 22 and 23 can be replaced by machined or molded receptacle 80. As noted, this receptacle is appended to tent 10 by virtue of fabric loop 81. It is quite apparent that the means of maintaining the spacing between rods 20 and 21 is not important. All that is important is that such spacing be maintained by any of a number of convenient alternative embodiments.

I claim:

1. A device to stabilize a tent, said tent comprising a fabric cover and a plurality of poles, said poles each having a length and a substantially circular cross-section and each pole being stressed under tension for engaging a portion of said fabric cover and each of said poles having distal ends for engaging a support surface, said device comprising two rods joined at a connector, said connector being characterized as having a channel approximately the size of said circular cross-section of said poles, said device further being provided with means for retaining said connector in a fixed position on said poles and further providing means for retaining spacing between said rods as said device is installed to stabilize said tent.

2. The device of claim 1 wherein said means to retain said connector in a fixed position on said poles comprises a strap for passing between said connector and the tent proximate the distal end of a pole to which the device is applied so that when said device has been installed upon said pole, said strap is under tension.

3. The device of claim 1 wherein said means to retain said connector in a fixed position on said poles comprises a rod passing between said connector and the tent proximate the distal end of a pole to which the device is applied.

4. The device of claim 1 wherein said means to retain said connector in a fixed position on said poles comprises a hook appended to said connector and a screw or cam passing through said hook which, when tightened, removably fixes said hook to the pole upon which the device is applied.

5. The device of claim 1 wherein said tent is provided with a plurality of eyelets, some of which are sized and positioned to receive and removably retain said distal ends of said poles.

6. The device of claim 5 wherein some of said eyelets are sized and positioned to receive and removably retain said rods once said device has been affixed to a pole.

7. The device of claim 1 wherein each of said two rods are maintained a fixed distance from each other once said device has been affixed to a pole.

8. The device of claim 7 wherein each of said two rods are connected at one of their ends to said connector and at their opposite ends by a cord or strap.

9. A device to stabilize a tent, said tent comprising a fabric cover and a plurality of poles, said poles each having a length and a substantially circular cross-section and each pole being stressed under tension for engaging a portion of said fabric cover and each of said poles having distal ends for engaging a support surface, said device comprising two rods hingedly connected to one another at a connector, said connector being characterized as having a channel approximately the size of said circular cross-section of said poles, said channel being changeable in size so that as said two rods are caused to move towards and away from each other, said connector can cause to be alternatively loosely fit over a pole or be clamped tightly to a pole, said device further being provided with a strap for passing between said connector and the tent proximate the distal end of a pole to which the device is applied so that when said device has been installed upon said pole, said strap is under tension.

10. The device of claim 9 wherein said tent is provided with a plurality of eyelets, some of which are sized and positioned to receive and removably retain said distal ends of said poles.

11. The device of claim 10 wherein some of said eyelets are sized and positioned to receive and removably retain said rods of said device once said device has been affixed to a pole.

12. The device of claim 10 wherein said strap is caused to be removably retained by a fabric loop located on said tent proximate the eyelet employed to removably retain the distal end of the pole to which the device is attached.

13. The device of claim 9 wherein said device is completely removable from a tent pole when not in use.

* * * * *